US009753427B2

(12) United States Patent
Maeda et al.

(10) Patent No.: US 9,753,427 B2
(45) Date of Patent: Sep. 5, 2017

(54) OPENING/CLOSING DETECTION MECHANISM AND IMAGE FORMING APPARATUS

(71) Applicant: KYOCERA Document Solutions Inc., Osaka-shi, Osaka (JP)

(72) Inventors: Hiroyuki Maeda, Osaka (JP); Yoshiaki Tashiro, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 15/090,625

(22) Filed: Apr. 5, 2016

(65) Prior Publication Data

US 2016/0291533 A1 Oct. 6, 2016

(30) Foreign Application Priority Data

Apr. 6, 2015 (JP) ..... 2015-077574
Feb. 4, 2016 (JP) ..... 2016-020016

(51) Int. Cl.
*G03G 15/00* (2006.01)
*G03G 21/16* (2006.01)

(52) U.S. Cl.
CPC . *G03G 21/1633* (2013.01); *G03G 2221/1654* (2013.01)

(58) Field of Classification Search
CPC ..... G03G 21/1623; G03G 21/1633; G03G 21/5004; G03G 15/80; G03G 2215/00978
See application file for complete search history.

(56) References Cited

U.S. PATENT DOCUMENTS

2011/0182614 A1* 7/2011 Onuma ..... G03G 21/1633 399/110
2012/0012445 A1* 1/2012 Ohta ..... G03G 21/1633 200/50.12

FOREIGN PATENT DOCUMENTS

JP 2002091250 A 3/2002

* cited by examiner

*Primary Examiner* — Walter L Lindsay, Jr.
*Assistant Examiner* — Jessica L Eley

(57) ABSTRACT

An opening/closing detection mechanism has a multifunctional peripheral body portion, a front cover, a side cover, and an interlock mechanism. The interlock mechanism contains a switch, a plate-like portion, a bulged portion, and a rocking mechanism. The bulged portion is provided on the side cover. When the side cover is in the closed state, the bulged portion abuts on a rear region located on the side opposite to the front cover with respect to a region where a projection portion is provided of the switch. The rocking mechanism rocks the switch in the opening/closing direction of the front cover according to the opened/closed state of the side cover.

8 Claims, 12 Drawing Sheets

OPENING/CLOSING DETECTION MECHANISM AND IMAGE FORMING APPARATUS

INCORPORATION BY REFERENCE

The disclosures of Japanese Patent Application Nos. 2015-77574 filed on Apr. 6, 2015 and 2016-20016 filed on Feb. 4, 2016 including the specification, drawings and abstract is incorporated herein by reference in its entirety.

BACKGROUND

The disclosure relates to an opening/closing detection mechanism and an image forming apparatus.

In an image forming apparatus typified by a multifunctional peripheral, an image of a document is read by an image reading unit, and then a photoconductor provided in an image forming unit is irradiated with light based on the read image to form an electrostatic latent image on the photoconductor. Thereafter, a charged toner is supplied onto the formed electrostatic latent image to form a visible image, the visible image is transferred to a paper, the visible image on the paper is fixed to the paper by a fixing device provided in the image forming apparatus, and then the paper is discharged to the outside of the apparatus.

In some cases, the image forming apparatus has an interlock mechanism of interrupting electric power to be supplied to the image forming unit when a front cover or a side cover is opened from the viewpoint of an improvement of safety. A technique relating to the image forming apparatus having the interlock mechanism has been known.

A typical image forming apparatus has a first door and a second door which are supported by the image forming apparatus body in such a manner that the first door and the second door can be individually opened/closed and a safety switch switching ON/OFF of energization to electric parts in synchronization with the opening/closing operation of at least one of the first door and the second door. The safety switch has a switch body which is movably supported by the image forming apparatus body and which takes a standby position in synchronization with the opening operation of the second door and takes an actuating position in synchronization with the closing operation of the second door and a movable portion which is movably supported by the switch body and takes an ON position by engagement of the first door and takes an OFF position by release of the engagement of the first door. In the standby state in which the first door and the second door are closed, the switch body is disposed at the actuating position and the first door in the closed state is engaged, whereby the movable portion is disposed at the ON position. When the first door is opened from the standby state, the engagement by the first door is released, so that the movable portion is disposed at the OFF position. When the second door is opened from the standby state, the switch body is disposed at the standby position and the engagement by the first door is released, so that the movable portion is disposed at the OFF position.

SUMMARY

In a first aspect of the disclosure, an opening/closing detection mechanism is an opening/closing detection mechanism which detects the opened/closed state of a door portion. The opening/closing detection mechanism has an apparatus body portion, a first door portion, a second door portion, and an interlock mechanism. The apparatus body portion has an approximately rectangular parallelepiped shape. In the apparatus body portion, internal devices are accommodated. The first door portion is provided on one side surface of the apparatus body portion and an upper end thereof can be opened/closed with respect to the apparatus body portion with a lower end as a fulcrum. The second door portion is provided on a side surface adjacent to the side surface on which the first door portion is provided, and an upper end thereof can be opened/closed with respect to the apparatus body portion with a lower end as a fulcrum. The interlock mechanism switches whether electric power required for the operation of the internal devices is supplied or interrupted according to the opened/closed state of the first door portion and the second door portion. The interlock mechanism contains a switch, a plate-like portion, a bulged portion, and a rocking mechanism. The switch is biased in a direction opposite to the pressing direction by the first door portion, has a projection portion which detects a first state by the pressing by the first door portion, and switches whether electric power required for the operation of the internal devices is supplied or interrupted according to the first state or a second state to be detected. The plate-like portion has a plate shape, moves in synchronization with the opening/closing operation of the first door portion, and presses the projection portion when the first door portion is in the closed state. The bulged portion is provided on the second door portion and abuts on a rear region located on the side opposite to the first door portion with respect to a region where the projection portion is provided of the switch when the second door portion is in the closed state. The rocking mechanism rocks the switch in the opening/closing direction of the first door portion according to the opened/closed state of the second door portion.

In another aspect of the disclosure, the image forming apparatus has a front cover and a side cover which can be individually opened/closed and has an image forming unit forming an image. The image forming apparatus contains the above-described opening/closing detection mechanism. The first door portion is the front cover. The second door portion is the side cover.

DETAILED DESCRIPTION

Figure 1:
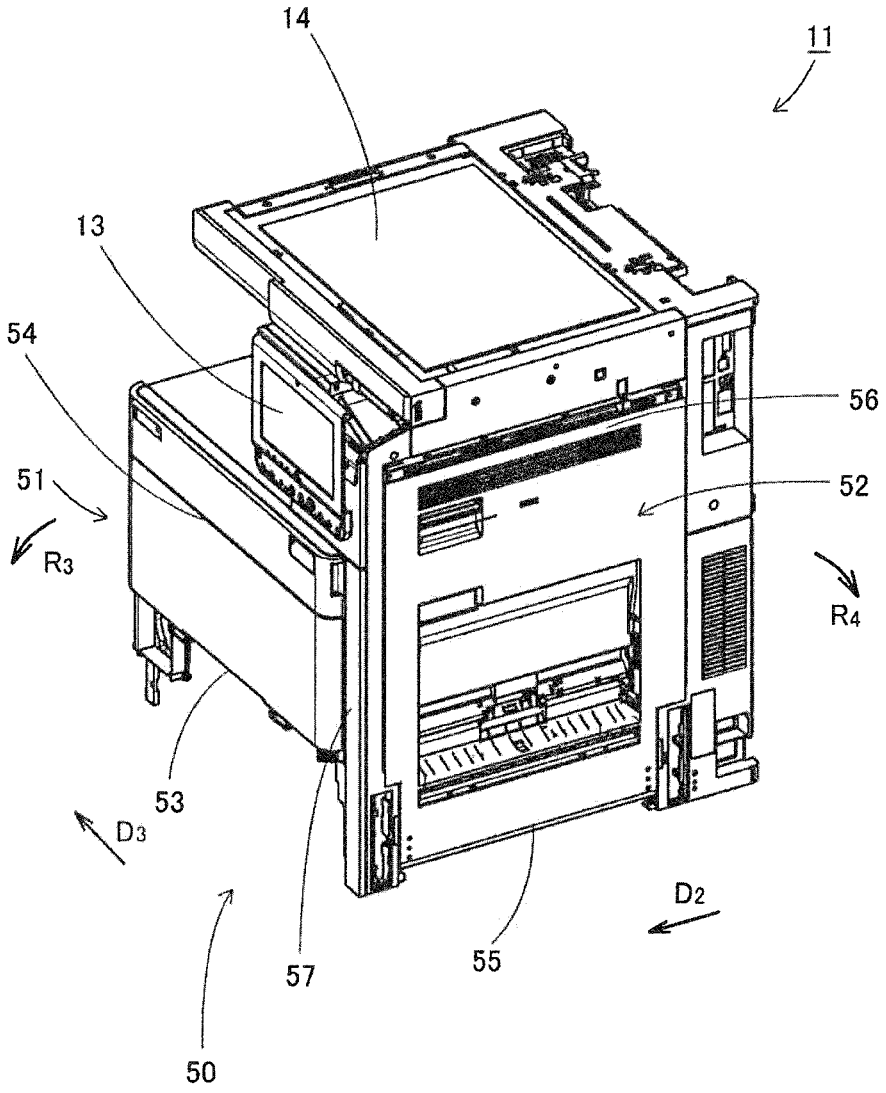
FIG. 1 is a view illustrating a part of the appearance of a multifunctional peripheral when an image forming apparatus according to one embodiment of the disclosure is applied to the multifunctional peripheral and is a view illustrating the state where both a front cover and a side cover are closed.
Figure 2:
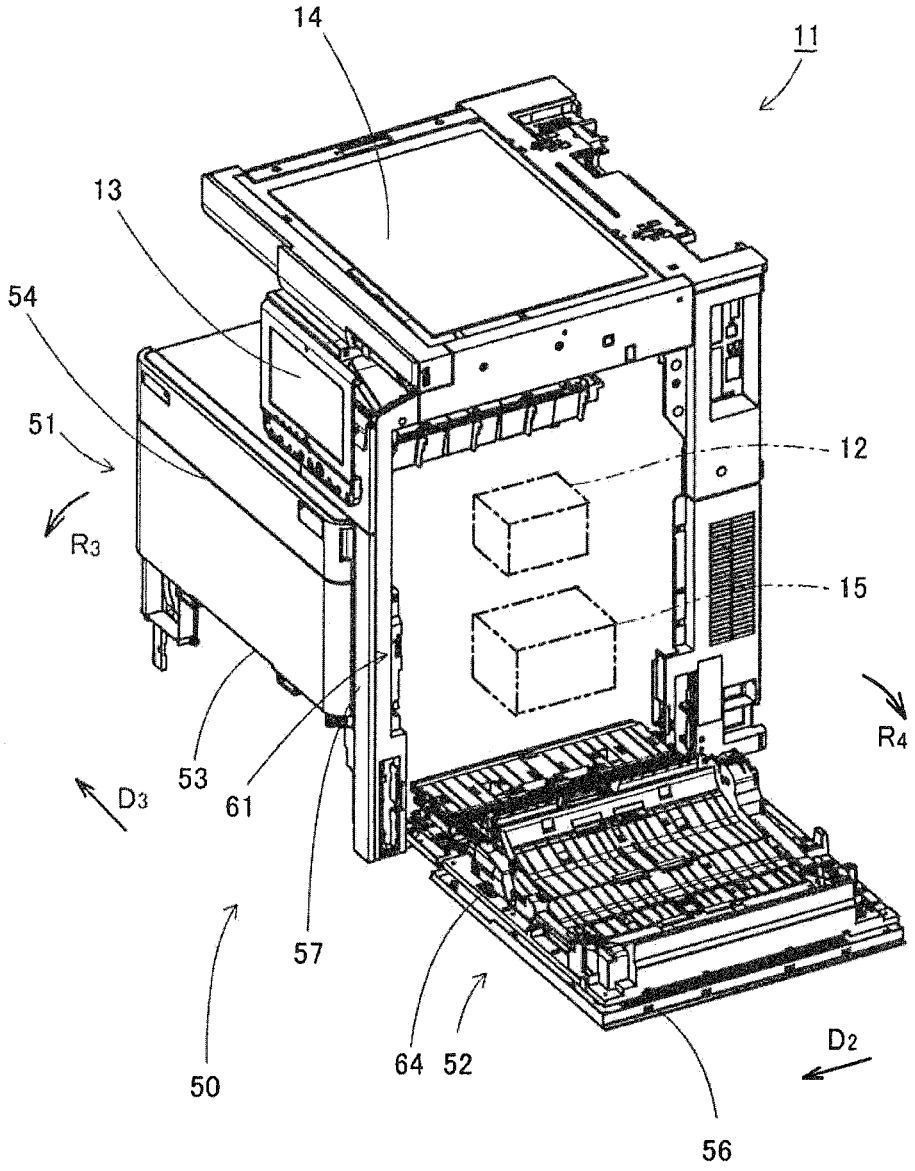
FIG. 2 is a view illustrating the state where only the side cover is opened in the multifunctional peripheral illustrated in FIG. 1.
Figure 3:
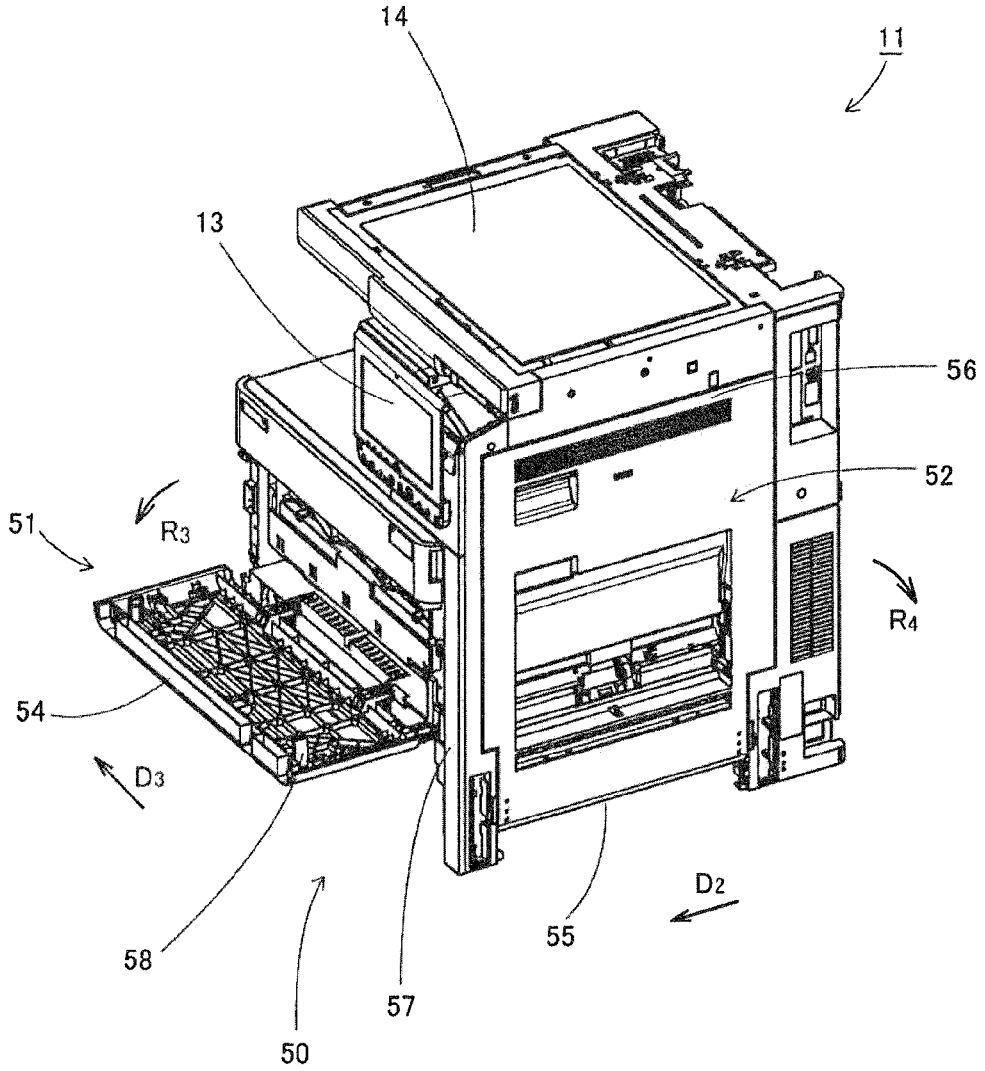
FIG. 3 is a view illustrating the state where only the front cover is opened in the multifunctional peripheral illustrated in FIG. 1.
Figure 4:
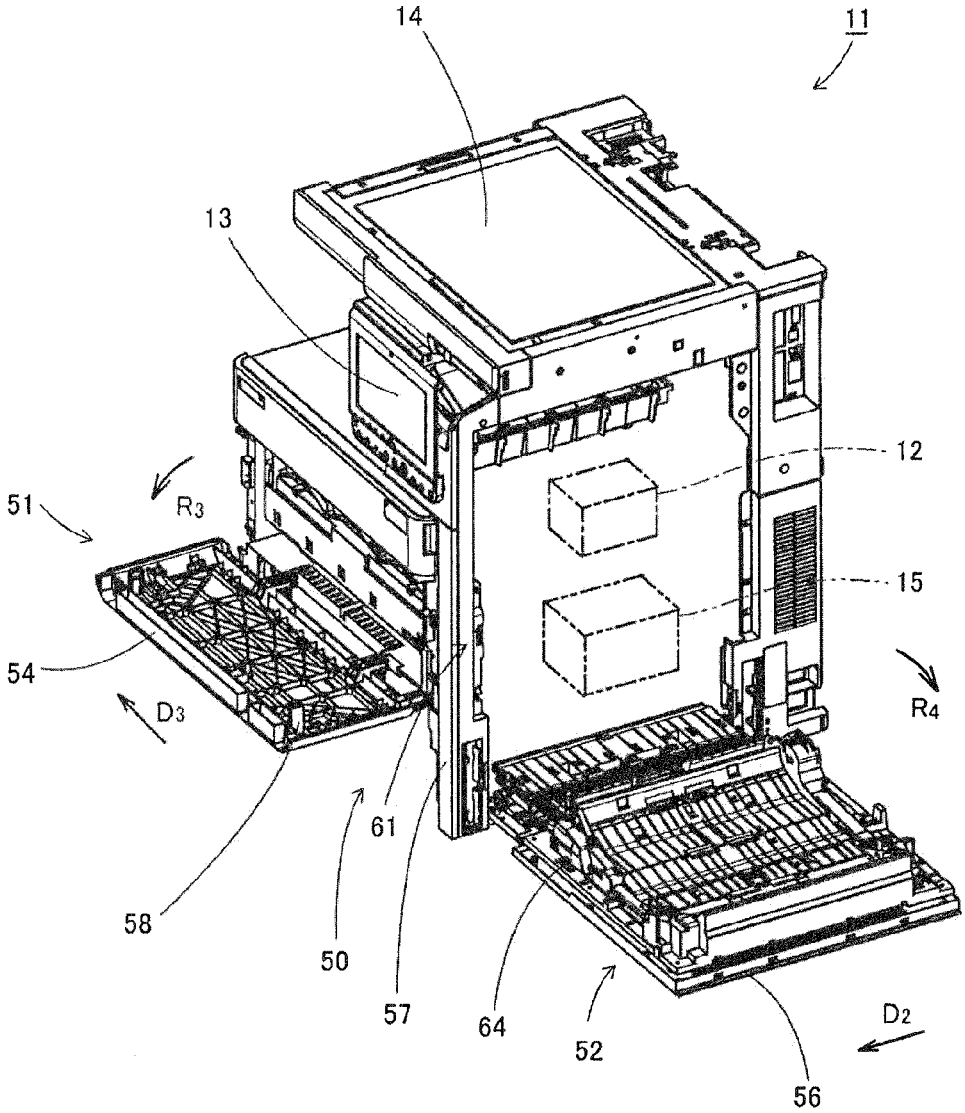
FIG. 4 is a view illustrating the state where both the front cover and the side cover are opened in the multifunctional peripheral illustrated in FIG. 1.

Hereinafter, an embodiment of the disclosure is described. FIG. 1 is a view illustrating a part of the appearance of a multifunctional peripheral 11 when an image forming apparatus according to one embodiment of the disclosure is applied to the multifunctional peripheral 11 and is a view illustrating the state where both a front cover 51 and a side cover 52 described later are closed. FIG. 2 is a view illustrating the state where only the side cover 52 is opened in the multifunctional peripheral 11 illustrated in FIG. 1. FIG. 3 is a view illustrating the state where only the front cover 51 is opened in the multifunctional peripheral 11 illustrated in FIG. 1. FIG. 4 is a view illustrating the state where both the front cover 51 and the side cover 52 are opened in the multifunctional peripheral 11 illustrated in FIG. 1.

With reference to FIG. 1 to FIG. 4, the multifunctional peripheral 11 has a control unit 12 (an example of the internal devices) having a CPU, an operation unit 13, an image reading unit 14, and an image forming unit 15 forming an image (an example of the internal devices). The configuration of the control unit 12 is schematically illustrated by the alternate long and short dash lines. The configuration of the image forming unit 15 is schematically illustrated by the chain double-dashed lines. Both the control unit 12 and the image forming unit 15 are accommodated inside a multifunctional peripheral body portion 57 described later.

The control unit 12 controls the entire multifunctional peripheral 11. The operation unit 13 displays information transmitted from the multifunctional peripheral 11 side and contents input by a user. The operation unit 13 allows a user to input image formation conditions, such as the number of print copies and gradation, or to turn ON or OFF a power supply. The image reading unit 14 reads an image of a document set on an auto document feeder (ADF) or a mounting table which are not illustrated. The image forming unit 15 forms an image on a paper based on the image read by the image reading unit 14 or image data transmitted through a network (not illustrated).

Herein, the multifunctional peripheral 11 contains an opening/closing detection mechanism 50. The opening/closing detection mechanism 50 is configured from a multifunctional peripheral body portion 57 as an apparatus body portion accommodating the internal devices, such as the image forming unit 15, the front cover 51 as a first door portion, the side cover 52 as a second door portion, and an interlock mechanism 61. The interlock mechanism 61 switches whether electric power to the internal devices is supplied or interrupted according to the opened/closed state of the front cover 51 and the side cover 52.

Figure 5:
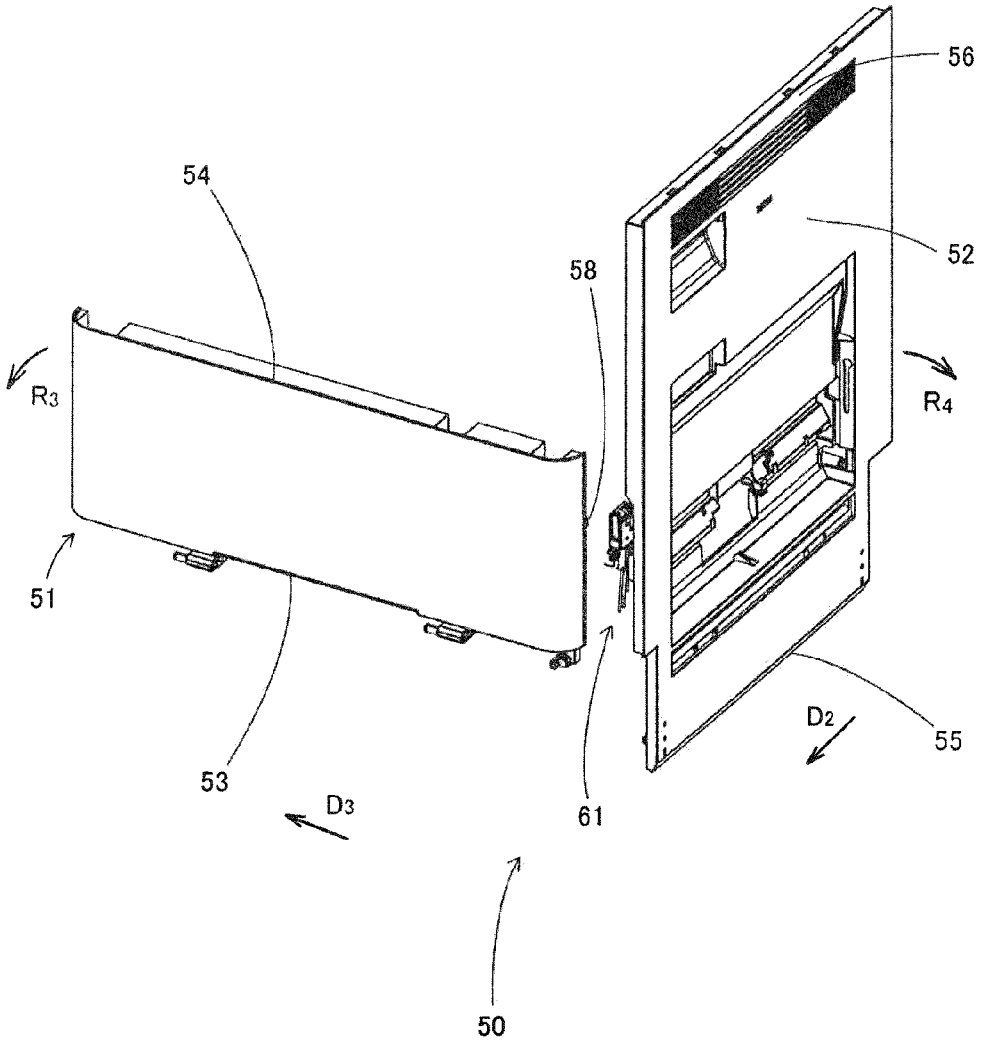
FIG. 5 is an exploded perspective view illustrating the front cover, the side cover, and an interlock mechanism provided in the multifunctional peripheral.
Figure 6:
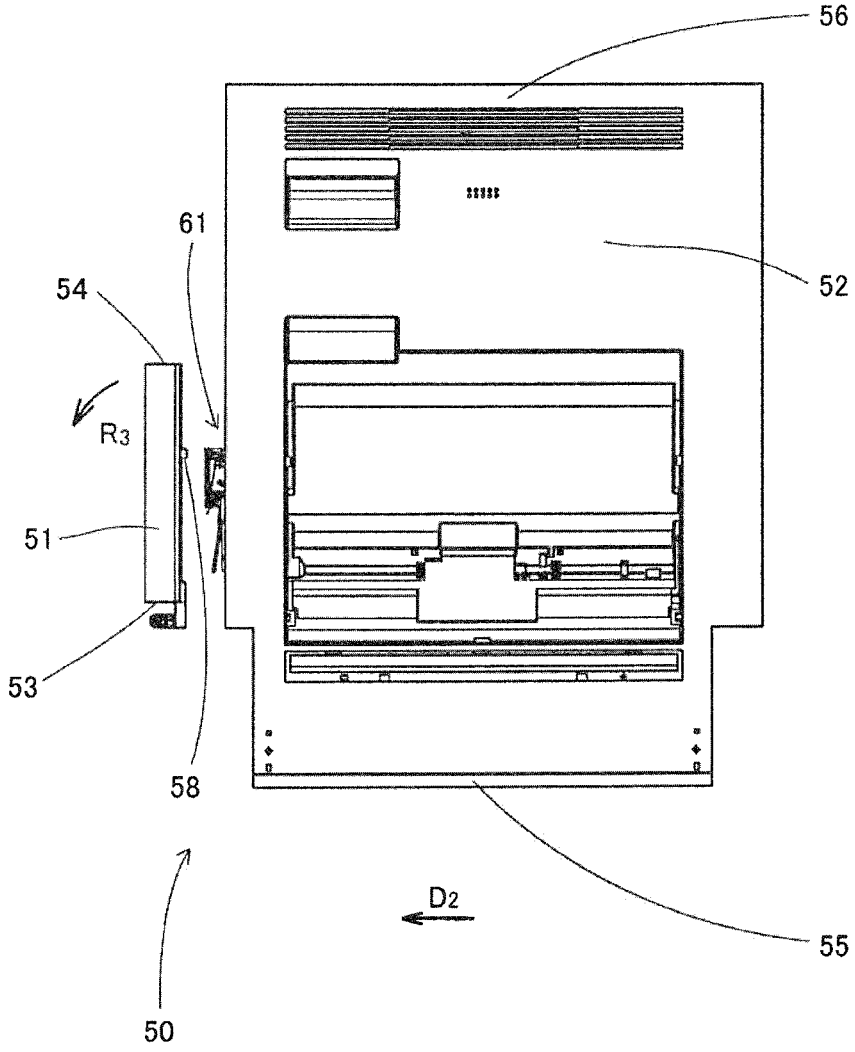
FIG. 6 is an exploded view illustrating a part of the multifunctional peripheral in a state where the side cover is closed.

FIG. 5 is an exploded perspective view illustrating the front cover 51, the side cover 52, and the interlock mechanism 61 provided in the multifunctional peripheral 11. FIG. 5 illustrates a view viewed from the outside of the multifunctional peripheral 11. FIG. 6 is an exploded view illustrating a part of the multifunctional peripheral 11 in the state where the side cover 52 is closed. FIG. 5 and FIG. 6 illustrate the state where the front cover 51 is removed from the multifunctional peripheral body portion 57. The arrow $D_2$ in FIG. 5 and FIG. 6 indicates the direction from the back side to the front side. The arrow $D_3$ in FIG. 5 and FIG. 6 indicates the direction from the right side of the apparatus to the left side of the apparatus.

With reference to FIG. 1 to FIG. 6, the front cover 51 is openably/closably attached to the front side of the multifunctional peripheral 11 with respect to the multifunctional peripheral body portion 57. The front cover 51 is attached in such a manner as to cover the front side of the image forming unit 15. The front cover 51 is configured so that an upper end 54 located on the upper side can be opened/closed with a lower end 53 located on the lower side as a fulcrum. By pulling down the upper end 54 located on the upper side of the front cover 51 to the front side, the front cover 51 can be brought into an opened state. When the internal devices are partially or completely exchanged or when an operation of internal devices, which are not illustrated, is interrupted for a certain reason during the operation, for example, the internal devices can be checked in the state where the front cover 51 is opened.

The front cover 51 is configured so that the closed state can be maintained by magnetic force. More specifically, the closed state of the front cover 51 is maintained by magnetic force with a metal member, which is not illustrated, provided near the upper end 54 on the upper side and a magnet, which is not illustrated, provided on the side of the multifunctional peripheral body portion 57, for example. On the back surface of the front cover 51, a pressing unit 58 (refer to FIG. 11) is provided which can detachably contact a plate-like portion 68 described later by the opening/closing movement of the front cover 51.

The side cover 52 is openably/closably attached to the side of the multifunctional peripheral 11 with respect to the multifunctional peripheral body portion 57, specifically the right side of the multifunctional peripheral 11 when the multifunctional peripheral 11 is viewed from the front side. The side cover 52 is attached in such a manner as to cover a so-called side portion of the multifunctional peripheral 11. The side cover 52 is also configured so that an upper end 56 can be opened/closed with a lower end 55 as a fulcrum. More specifically, by pulling the upper end 56 of the side cover 52 down in the horizontal direction, the side cover 52 can be brought into an opened state. In the state where the side cover 52 is brought into the opened state, the internal devices disposed inside the side cover 52 can be checked.

The side cover 52 is also configured so that the closed state can be maintained by magnetic force. More specifically, the closed state of the side cover 52 is maintained by magnetic force with a metal member, which is not illustrated, provided near the upper end 56 and a magnet, which is not illustrated, provided on the side of the multifunctional peripheral body portion 57, for example.

Figure 7:
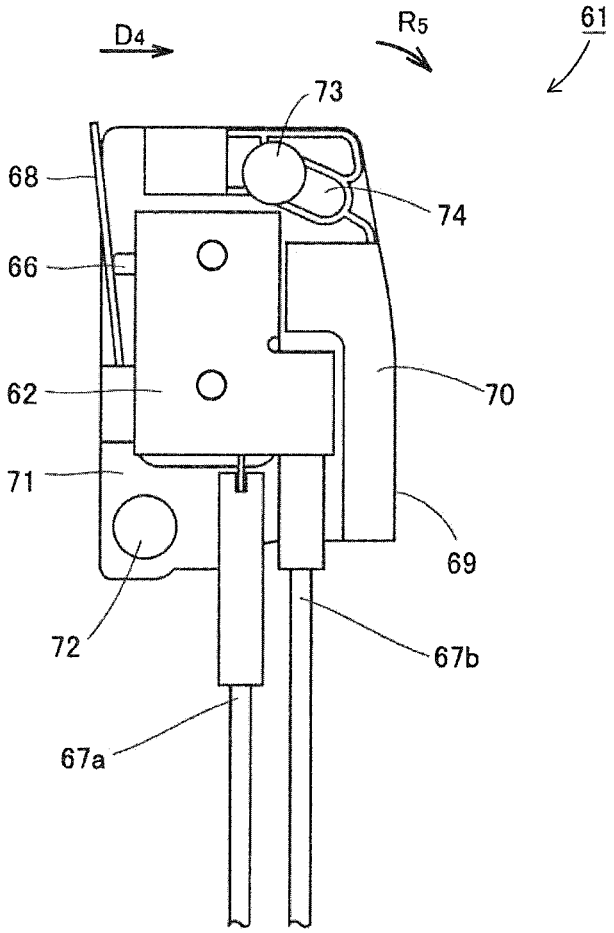
FIG. 7 is a view illustrating the circumference of a switch contained in the interlock mechanism and is a view viewed from the direction indicated by the arrow $D_3$.
Figure 8:
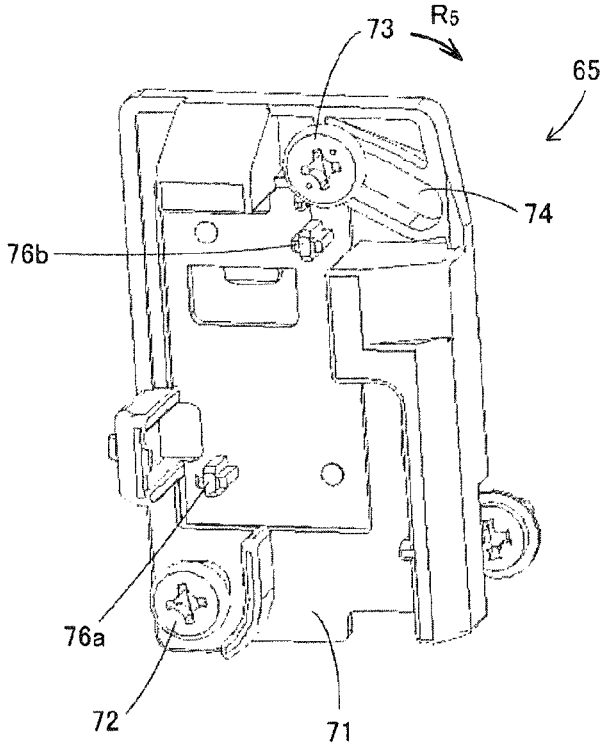
FIG. 8 is a perspective view illustrating the circumference of the switch contained in the interlock mechanism.
Figure 9:
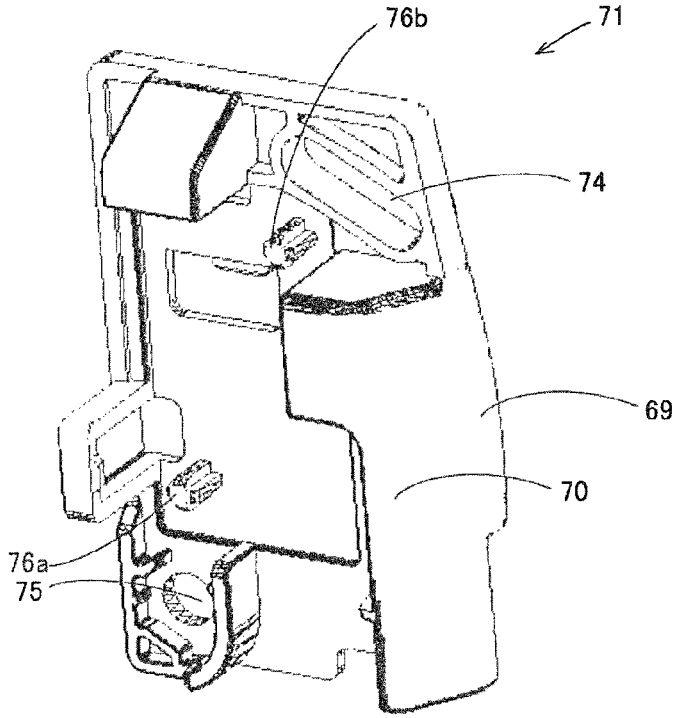
FIG. 9 is a perspective view illustrating a holder contained in a rocking mechanism provided in the interlock mechanism.
Figure 10:
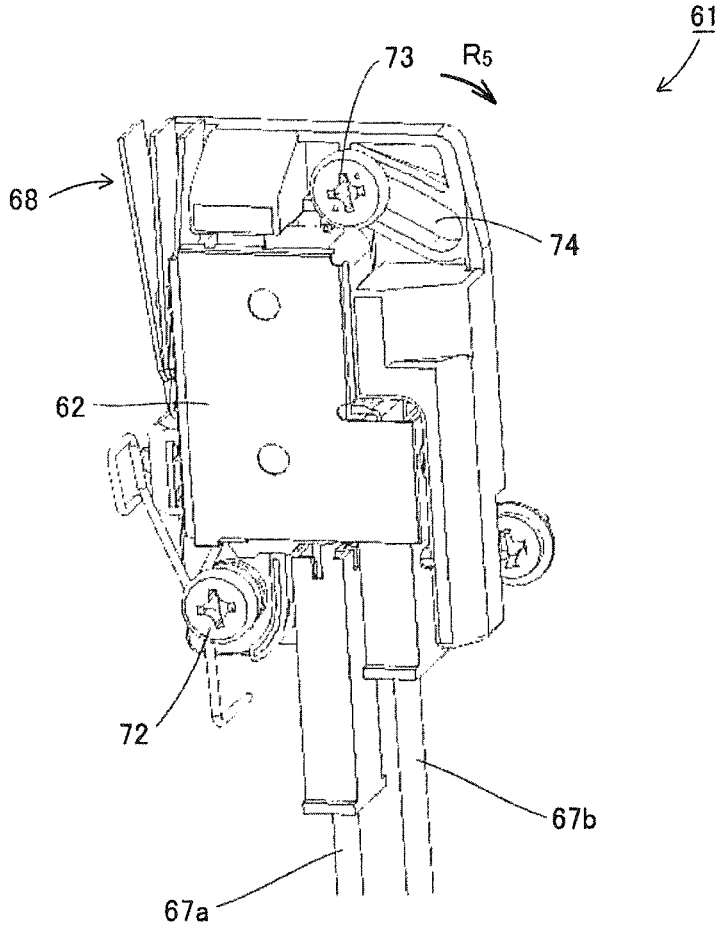
FIG. 10 is a view illustrating the state where the holder illustrated in FIG. 9 is attached.

FIG. 7 is a view illustrating the circumference of a switch 62 contained in the interlock mechanism 61 and is a view viewed from the direction indicated by the arrow $D_3$ in FIG. 1. FIG. 8 is a perspective view illustrating the circumference of the switch 62 contained in the interlock mechanism 61. FIG. 9 is a perspective view illustrating a holder 71 contained in a rocking mechanism 65 provided in the interlock mechanism 61. FIG. 10 is a view illustrating the state where the holder 71 illustrated in FIG. 9 is attached to the multifunctional peripheral body portion 57. FIG. 10 illustrates two or more of the plate-like portions 68 described later.

Herein, with reference to FIG. 1 to FIG. 10, the interlock mechanism 61 contains the switch 62, the plate-like portion(s) 68, a bulged portion 64, and the rocking mechanism 65.

The switch 62 has a thin plate-like case. The switch 62 has an approximately rectangular shape as viewed from the plate thickness direction. The switch 62 contains a circuit and the like, which are not illustrated, detecting an ON state which is a first state and an OFF state which is a second state.

The switch 62 has a projection portion 66 which brings the switch 62 into the ON state by being pressed. The projection portion 66 is provided in such a manner as to project from a part of the switch 62. The direction in which the projection portion 66 projects is a direction perpendicular to the plate thickness direction of the thin plate-like switch 62. The projection portion 66 is biased in a direction opposite to the pressing direction toward the inner side of the switch 62. More specifically, the projection portion 66 is biased in a direction opposite to the direction indicated by the arrow $D_4$ in FIG. 7. The direction indicated by the arrow $D_4$ is a direction from the front side to the back side when the switch 62 is attached to the multifunctional peripheral 11.

To the switch 62, a pair of cables 67*a* and 67*b* extending to the outside are attached. By bringing the cables 67*a* and 67*b* into conduction, electric power is supplied to the interlock mechanism 61 and also the detection results detected by the switch 62, i.e., a signal of the ON state or the OFF state detected by the switch 62, can be transmitted to the control unit 12.

With respect to the plate-like portion 68, one end is attached to the switch 62 side and the other end is not attached and is interlocked with the opening operation of the front cover 51. The plate-like portion 68 moves according to the contact/separation state of the pressing unit 58, described later, which is provided on the front cover 51, to the plate-like portion 68. Specifically, the free end of the plate-like portion 68 is pressed by the pressing unit 58 or is released from the pressing by the pressing unit 58.

The bulged portion 64 is provided on the back surface of the side cover 52 as illustrated in FIG. 2, and thus moves in synchronization with the opening/closing operation of the side cover 52. The bulged portion 64 has a rectangular parallelepiped shape. The bulged portion 64 abuts on a rear region 69 located on the side opposite to the front cover 51 with respect to a region where the projection portion 66 is provided of the switch 62 (refer to FIG. 11), when the side cover 52 is in the closed state. On the other hand, when the state of the side cover 52 is shifted to the opened state from the closed state, the bulged portion 64 moves in synchronization with the opening operation of the side cover 52 to be positioned at a position spaced from the rear region 69.

The rocking mechanism 65 rocks the switch 62 in the opening/closing direction of the front cover 51 according to the opened/closed state of the side cover 52. The opening/closing direction of the front cover 51 is the direction indicated by the arrow $R_5$ in FIG. 7, FIG. 8, and FIG. 10 or the opposite direction.

The rocking mechanism 65 contains the holder 71 holding the switch 62, a rotation shaft 72 serving as the rotation center of the rocking movement, and a supporting rod 73 guiding the rocking movement. The rotation shaft 72 and the supporting rod 73 are members for attaching the holder 71 to the multifunctional peripheral body portion 57. The holder 71 also has an approximately thin plate shape. The holder 71 is configured to hold the switch 62 in such a manner as to be engaged on one surface in the plate thickness direction thereof. The holder 71 is provided with a guide groove 74 which is opened along the rocking direction and into which the supporting rod 73 is inserted and a support hole 75 which is opened in a round hole shape so as to allow the insertion of the rotation shaft 72. The rotation shaft 72 and the supporting rod 73 are attached to the multifunctional peripheral body portion 57. The holder 71 can perform rocking movement along the guide groove 74 around the rotation shaft 72. In synchronization with the rocking movement of the holder 71, the switch 62 held by the holder 71 also performs rocking movement.

The holder 71 is provided with a pair of holding projections 76*a* and 76*b* which are disposed on a diagonal line and project to the side on which the switch 62 is held. The switch 62 is held by the holder 71 in such a manner that the pair of holding projections 76*a* and 76*b* are correspondingly engaged into a pair of concave portions, which are not illustrated, provided in the switch 62.

A bulged portion guide portion 70 from the central region to the rear region 69 in the front-back direction of the holder 71 is formed from a curved surface. Specifically, with respect to the thickness in the plate thickness direction of the holder 71, the bulged portion guide portion 70 is formed from a gentle arc-shaped curved surface in such a manner that the central region has the largest thickness and the rear region 69 has the smallest thickness.

Figure 11:
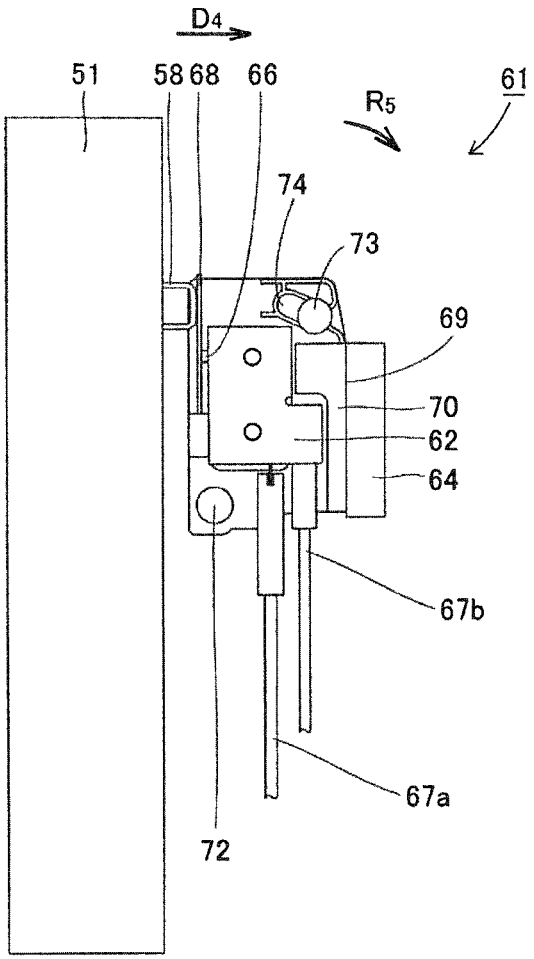
FIG. 11 is a view illustrating the circumference of the interlock mechanism when both the front cover and the side cover are closed.
Figure 12:
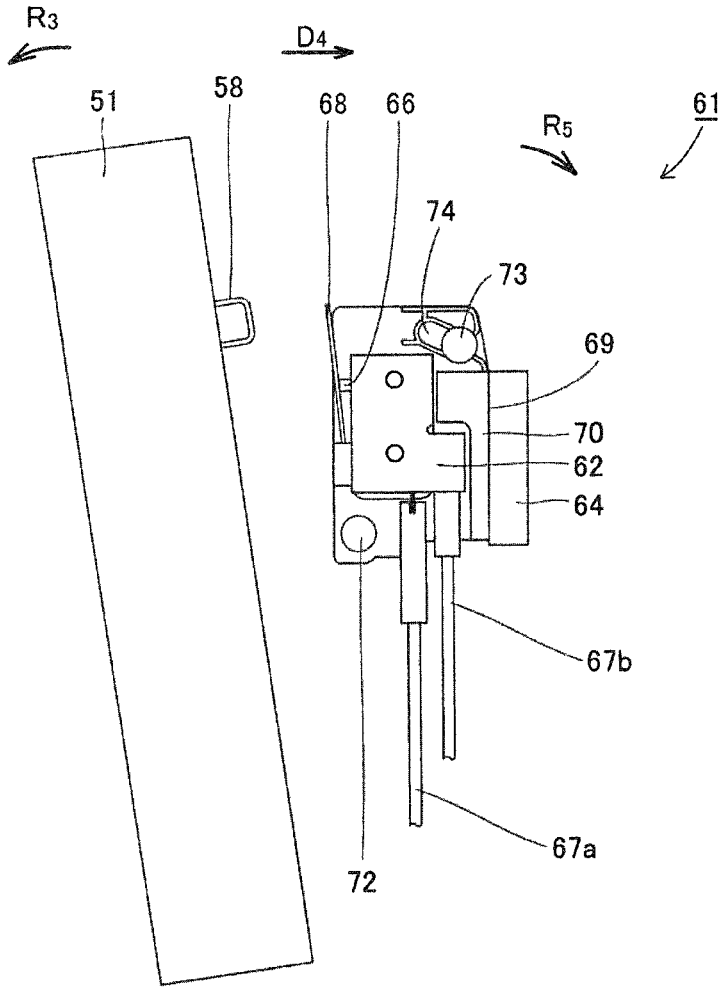
FIG. 12 is a view illustrating the circumference of the interlock mechanism when the front cover is opened in the state where the side cover is closed.
Figure 13:
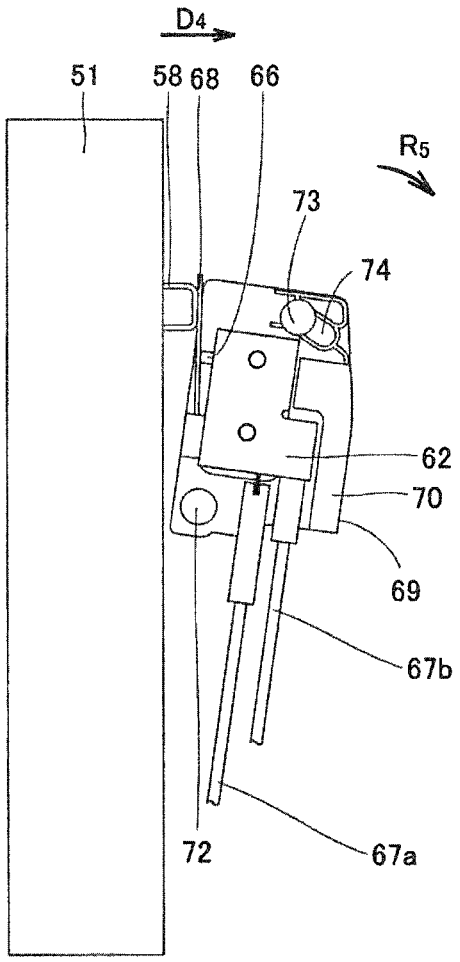
FIG. 13 is a view illustrating the circumference of the interlock mechanism when the side cover is opened in the state where the front cover is closed.

Next, the operation of such an interlock mechanism 61 is described. FIG. 11 is a view illustrating the circumference of the interlock mechanism 61 when both the front cover 51 and the side cover 52 are closed. This state is the state illustrated in FIG. 1 and is equivalent to the state during the image formation in the image forming unit 15. More specifically, FIG. 11 illustrates the state where the interlock mechanism 61 is in the ON state and electric power required for the operation of the internal devices is supplied, specifically electric power is supplied to each member configuring the image forming unit 15, for example. In FIG. 11, FIG. 12, and FIG. 13, only a part of the side cover 52 is illustrated and the other portions are omitted.

With reference to FIG. 1 to FIG. 11, when the side cover 52 is in the closed state, the bulged portion 64 abuts on the rear region 69. Therefore, the rocking movement of the switch 62 held by the holder 71 in such a manner as to be able to rock is regulated. Specifically the, movement of the switch 62 in the direction indicated by the arrow $R_5$ around the rotation shaft 72 is stopped. The position of the switch 62 in this case is defined as a first rocking position.

In such a state and in the state where the front cover 51 is closed, the pressing unit 58 provided on the back surface of the front cover 51 presses the projection portion 66 through the plate-like portion 68. More specifically, in the closed state of the front cover 51, the pressing unit 58 provided on the front cover 51 is drawn to the inner side of the multifunctional peripheral 11 by magnetic force. The magnetic force is applied in the direction indicated by the arrow $D_4$ to the pressing unit 58 through the plate-like portion 68. More specifically, the projection portion 66 is brought into the pressed state by the plate-like portion 68.

In such a state, the projection portion 66 is brought into the pressed state, the switch 62 detects the ON state. More specifically, the switch 62 is disposed at the first rocking position due to the fact that, when the side cover 52 is brought into the closed state and the front cover 51 is brought into the closed state, the bulged portion 64 and the rear region 69 abut on each other, whereby the rocking movement of the switch 62 is regulated. The projection portion 66 is pressed by the plate-like portion 68 which moves in synchronization with the front cover 51, the switch 62 detects the ON state. Then, the switch 62 notifies the detection of the ON state to the control unit 12. Then, the control unit 12 supplies electric power required for the operation of the internal devices to the internal devices based on the detection of the ON state.

Next, the case where the front cover 51 is opened in the state where the side cover 52 is being closed is described. FIG. 12 is a view illustrating the circumference of the interlock mechanism 61 when the front cover 51 is opened in the state where the side cover 52 is being closed. FIG. 12 is a view in the state illustrated in FIG. 3.

With reference to FIG. 1 to FIG. 12, when the upper end 54 of the front cover 51 is pulled down to the front side along the direction indicated by the arrow $R_3$ in FIG. 3 and FIG. 12, the pressing unit 58 provided on the back surface of the front cover 51 moves in the direction indicated by the arrow $R_3$ in FIG. 12. Thus, the projection portion 66 which is being pressed through the plate-like portion 68 is released from the pressing. In this case, the side cover 52 is in the closed state, so that the rocking movement of the switch 62 is regulated and the projection portion 66 is biased in a direction opposite to the pressing direction by the pressing unit 58 toward the inner side of the switch 62. Therefore, the projection portion 66 and the plate-like portion 68 are biased by the biasing force in a direction opposite to the direction indicated by the arrow $D_4$ in FIG. 8. As a result, the switch 62 is brought into the OFF state from the ON state. More specifically, the switch 62 detects the OFF state.

The switch 62 notifies the detection of the OFF state to the control unit 12. Then, the control unit 12 interrupts the supply of the electric power required for the operation of the internal devices based on detection of the OFF state. Therefore, the interruption of the supply of the electric power prevents an operation that a roller, a conveying belt conveying a paper (not illustrated), and the like start to rotate due to the fact that, for example, a motor configuring the image forming unit 15 suddenly starts to rotate by the supply of electric power in the state where the front cover 51 is opened. Therefore, a user can safely remove a paper remaining on the conveying belt, for example.

Next, the case where the side cover 52 is opened in the state where the front cover 51 is being closed is described. FIG. 13 is a view illustrating the circumference of the interlock mechanism 61 when the side cover 52 is opened in the state where the front cover 51 is being closed. FIG. 13 illustrates a view in the state illustrated in FIG. 2.

With reference to FIG. 1 to FIG. 13, when the upper end 56 (illustrated in FIG. 1 and FIG. 3) of the side cover 52 is pulled down to the right side along the direction indicated by the arrow $R_4$, the bulged portion 64 provided on the back surface of the side cover 52 moves in the direction indicated by the arrow $R_5$ in FIG. 13. Thus, the abutting of the bulged portion 64 and the rear region 69 is released. Then, the switch 62 whose movement was regulated rotates with the holder 71, by the biasing force of the projection portion 66, at a predetermined angle in the direction indicated by the arrow $R_5$ in FIG. 13 around the rotation shaft 72. The predetermined angle is a rotation angle permitted by the guide groove 74. More specifically, the switch 62 rocks around the rotation shaft 72. The position of the switch 62 in this case is defined as a second rocking position. As a result, the switch 62 is brought into the OFF state from the ON state. More specifically, when the side cover 52 is brought into the opened state, the abutting of the bulged portion 64 and the rear region 69 is released, so that the switch 62 moves to the second rocking position by the biasing force of the projection portion 66, and thus the projection portion 66 is released from the pressing. Therefore, the switch 62 detects the OFF state.

The switch 62 notifies the detection of the OFF state to the control unit 12. Then, the control unit 12 interrupts the supply of the electric power required for the operation of the internal devices as in the case where illustrated in FIG. 12 based on the detection of the OFF state. The interruption of the supply of the electric power prevents an operation that a roller, a conveying belt conveying a paper (not illustrated), and the like start to rotate due to the fact that, for example, a motor configuring the image forming unit 15 suddenly starts to rotate by the supply of electric power in the state where the side cover 52 is opened. Therefore, a user can safely remove a paper remaining on the conveying belt, for example.

According to the description above, the multifunctional peripheral 11 having such a configuration can switch whether electric power required for the operation of the internal devices, e.g., electric power required for image formation, is supplied or interrupted based on the ON state or the OFF state detected by one switch 62 according to the opened/closed state of the front cover 51 and the side cover 52. In this case, since the multifunctional peripheral 11 is configured to detect the ON state and the OFF state by the switch 62 according to the biasing force of the projection portion 66 and the rocking position of the switch 62, the ON state or the OFF state can be detected with high precision without requiring a complicated mechanism. Therefore, the safety can be more efficiently improved.

In this case, since the bulged portion guide portion 70 from the central region to the rear region 69 is formed from a curved surface, the bulged portion 64 can be appropriately guided along the curved surface to be allowed to abut on the rear region 69 in closing the side cover 52. Therefore, the closing of the side cover 52 can be detected with high precision.

Moreover, in this case, the multifunctional peripheral 11 is configured so that the guide groove 74 is provided in the holder 71 and the holder 71 is guided by the supporting rod 73 in the rocking movement of the holder 71, and therefore the rocking movement of the holder 71 holding the switch 62 can be more smoothly performed.

Moreover, in this case, the interlock mechanism 61 contains the plate-like portion 68, and therefore, even when the position pressed by the pressing unit 58 is somewhat shifted in the vertical direction, the projection portion 66 can be appropriately pressed down.

When both the front cover 51 and the side cover 52 are in the opened state as illustrated in FIG. 4, the abutting of the bulged portion 64 and the rear region 69 is released and also the pressing unit 58 is apart from the plate-like portion 68. Therefore, the switch 62 detects the OFF state.

In the embodiment described above, the opening/closing detection mechanism 50 is contained in the multifunctional peripheral 11 but other devices may be contained without being limited to the configuration. More specifically, the opening/closing detection mechanism 50 may be configured to have an approximately rectangular parallelepiped-shaped apparatus body portion, a first door portion, a second door portion, and an interlock mechanism and to detect the opening and the closing of a door portion configuring other devices, such as an image reading device.

The embodiments and examples as disclosed herein should be understood to be illustrative in all respects and not restrictive in any aspect. The scope of the disclosure is specified not by the foregoing description but by Claims, and all alternations that come within the meaning and range of equivalency of Claims are to be embraced within its scope.

The opening/closing detection mechanism and the image forming apparatus according to the disclosure are particularly effectively utilized when a more efficient improvement of safety is required.

What is claimed is:

1. An opening/closing detection mechanism detecting an opened/closed state of a door portion, comprising:

an apparatus body portion having an approximately rectangular parallelepiped shape and accommodating internal devices;

a first door portion which is provided on one side surface of the apparatus body portion and an upper end thereof can be opened/closed with respect to the apparatus body portion with a lower end thereof as a fulcrum, and which is brought into an opened state by pulling down the upper end to a front side;

a second door portion provided on a side surface adjacent to the side surface on which the first door portion is provided and an upper end thereof can be opened/closed with respect to the apparatus body portion with a lower end thereof as a fulcrum, and which is brought into an opened state by pulling down the upper end in a horizontal direction; and an interlock mechanism switching whether electric power required for an operation of the internal devices is supplied or interrupted according to the opened/closed state of the first door portion and the second door portion, wherein the interlock mechanism contains a switch has a projection portion, which is biased in a direction opposite to a pressing direction by the first door portion and for detecting a first state by pressing by the first door portion, and switches whether electric power required for the operation of the internal devices is supplied or interrupted according to the first state or a second state to be detected, a plate-like portion having a plate shape, moving in synchronization with the opening/closing operation of the first door portion, and pressing the projection portion when the first door portion is in a closed state, a bulged portion provided on the second door portion and abutting on a rear region located on a side opposite to the first door portion with respect to a region where the projection portion is provided of the switch when the second door portion is in a closed state, and a rocking mechanism rocking the switch in an opening/closing direction of the first door portion according to the opened/closed state of the second door portion.

2. The opening/closing detection mechanism according to claim 1, wherein when the second door portion and the first door portion are in a closed state, the bulged portion and the rear region are caused to abut, whereby the switch is disposed at a first rocking position to regulate rocking movement of the switch and when the projection portion is pressed by a pressing unit provided on the first door portion, the switch is brought into the first state, when the second door portion is brought into an opened state, the switch is moved to a second rocking position by biasing force of the projection portion to release the pressing of the projection portion, whereby the switch is brought into the second state, and when the first door portion is brought into an opened state, the projection portion is not pressed by the pressing unit, so that the switch is brought into the second state.

3. The opening/closing detection mechanism according to claim 1, wherein the rocking mechanism contains a holder having a guide groove guiding rocking movement of the switch and a support hole for supporting a rotation shaft in the rocking movement of the switch and holding the switch.

4. The opening/closing detection mechanism according to claim 3, wherein the holder is provided with a bulged portion guide portion which has a curved surface shape and guides the bulged portion to the rear region.

5. The opening/closing detection mechanism according to claim 1, wherein the switch has a thin plate shape.

6. An image forming apparatus forming an image comprising:

a front cover and a side cover which can be individually opened/closed, wherein the image forming apparatus contains the opening/closing detection mechanism according to claim 1, the first door portion is the front cover, and the second door portion is the side cover.

7. The opening/closing detection mechanism according to claim 1, wherein the rocking mechanism contains a holder for holding the switch and a rotation shaft for attaching the holder to the apparatus body portion, and the holder can perform rocking movement around the rotation shaft.

8. The opening/closing detection mechanism according to claim 1, wherein the rocking mechanism further contains a supporting rod for attaching the holder to the apparatus body portion, Wherein the holder is provided with a guide groove into which the supporting rod is inserted and a support hole into which the rotation shaft is inserted, and the holder can perform rocking movement along the guide groove around the rotation shaft.

* * * * *